United States Patent [19]

Inoue

[11] 4,130,493

[45] Dec. 19, 1978

[54] MACHINING FLUID

[75] Inventor: Kiyoshi Inoue, Tokyo, Japan

[73] Assignee: Inoue-Japax Research Incorporated, Yokohama, Japan

[21] Appl. No.: 816,966

[22] Filed: Jul. 19, 1977

[30] Foreign Application Priority Data

| | | | |
|---|---|---|---|
| Jul. 20, 1976 | [JP] | Japan | 51-86330 |
| Sep. 17, 1976 | [JP] | Japan | 51-112301 |
| Dec. 21, 1976 | [JP] | Japan | 51-153892 |
| Jan. 18, 1977 | [JP] | Japan | 52-3512 |

[51] Int. Cl.[2] ..... C10M 1/10; C10M 3/02; C10M 5/02; C05B 11/16

[52] U.S. Cl. ..... 252/28; 72/42; 252/25; 252/49.3; 252/49.5; 252/56 R; 252/396

[58] Field of Search ..... 252/49.5, 28, 49.3, 252/56 R, 25, 396; 72/42

[56] References Cited

U.S. PATENT DOCUMENTS

| | | | |
|---|---|---|---|
| 3,341,554 | 9/1967 | Murray et al. | 252/56 R |
| 3,945,931 | 3/1976 | Bussi et al. | 252/49.3 |
| 3,948,784 | 4/1976 | Krillic et al. | 252/25 |
| 3,974,674 | 8/1976 | Orozco et al. | 252/25 |

*Primary Examiner*—Irving Vaughn
*Attorney, Agent, or Firm*—Karl F. Ross

[57] ABSTRACT

A machining fluid includes a basic component in the form of an aqueous solution and an aliphatic acid organic compound which is produced by a fermentation process comprising cultivating a microorganism in a culture medium containing a saccharide, nitrogen source and an inorganic salt and accumulated in a culture broth and separated and recovered from the culture broth.

12 Claims, No Drawings

MACHINING FLUID

BACKGROUND OF THE INVENTION

The present invention relates to a machining fluid suitable for a wide variety of machining operations including electrochemical shaping, cavity-sinking, milling, drilling, cutting, honing, grinding and polishing operations utilizing electrochemical erosion action possibly in combination with other material-removal action (which are generally referred to herein as electrochemical machining), electrical-discharge shaping, cavity-sinking, milling, drilling, cutting, grinding and polishing operations utilizing electrical-discharge erosion action possibly in combination with other material removal action (which are generally referred to herein as electrical discharge machining) and conventional shaping, cavity-sinking, milling, drilling, cutting, honing, grinding, polishing and other purely mechanical machining operations. The latter is intended to include also turning, broaching, reaming, threading, rolling, gearing, sawing, forming, deburring, forging, burnishing, etc.

In all machining operations as described, significant problems arise vis-a-vis the machining fluid.

Thus, in electrochemical machining, the machining fluid serving as the electrochemical reaction media across the machining gap is an aqueous solution of an electrolyte which has made anti-corrosion measures unavoidable.

In electrical discharge machining, kerosene and the like oil products have long been utilized as the spark discharge media because of their high dielectric constant and since they pose practically no corrosion problem. In the travelling-wire electrical-discharge machining process, however, in which a wire or a like elongated electrode is continuously passed through the machining zone formed between the same and a workpiece and relatively displaced transversely thereto, distilled water is now commonly employed which is flushed through the machining zone positioned in the atmosphere. In such processes, the use of the flammable oil exposed to the air is impossible or impractical. Even in other modes of electrical discharge machining, the use of water is preferred, apart from its ready availability, since thanks to its lower viscosity water allows a higher flushing flow into which is required to insure prompt removal of machining chips and other discharge products, rapid cooling and instantaneous arc extinction through an extremely narrow machining gap. Here again, however a corrosion problem arises with water which causes the machining equipment, unless protective measures an applied, as well as workpiece surfaces to rust.

Machining fluids for mechanical machining have compositions to which enable them reduce friction between a tool and a workpiece during the machining process, to prevent or alleviate tool wear, and to protect tool and/or workpiece surfaces from becoming welded by machining chips while limiting the generation of heat and facilitating the thermal emission from the machining region thereby insuring desired fine finished surfaces and an extended tool like. There are, here too, corrosion and rust problems when the machining media is diluted with water.

Thus, various additives have been proposed in the respective machining techniques described, but these additives are more or less unsatisfactory and expensive, harmful, noxious and/or have the effect of reducing the machining efficiency.

OBJECT OF THE INVENION

It is, therefore, the object of the present invention to provide a machining fluid whereby the aforementioned disadvantages of conventional machining fluids are overcome.

DESCRIPTION OF THE INVENTION

This invention is based upon the discovery that an improved machining fluid is obtained by incorporating into a basic component of a conventional machining medium, a compound produced by a certain microbial fermentation process.

Thus, according to the present invention, a machining fluid includes an aqueous basic component and an organic compound which is produced by a fermentation process comprising cultivating a microorganism in a culture medium containing a saccharide, a nitrogen source and an inorganic salt and accumulated in a culture broth and separated and recovered from the culture broth.

The microorganism is preferably a member of bacteria or fungi classes bacterium of Arthrobacter genus, *Penicillium spiculisporum, Aspergillus spiculsporum* and yeast fungi of Candia genus.

The saccharide preferably is at least one compound selected from the class consisting of glucose, fructose, sucrose, molasses and starch.

The nitrogen source is preferably at least one compound selected from the class consisting of ammonium chloride, ammonium sulfate, ammonium phosphate, ammonium liquid, ammonium tartrate, sodium nitrate, urea, corn steep liquor, peptone, yeast extract, meat extract and casein.

The inorganic salt is preferably at least one compound selected from the class consisting of magnesium sulfate, sodium phosphate, acidic potasium phosphate, ferrous sulfate and zinc sulfate.

The proportion of said inorganic compound in a machining fluid is preferably between 50 and 20000 ppm, it being noted that the best result is obtainable when the proportion ranges between 500 and 1000 ppm.

The said organic compound which may be referred to herein as an aliphatic acid or an anhydrous derivative thereof preferably has a molecular structure having not less than 10 carbon atoms, 3 carboxy radicals and 1 hydroxide radical and may be one having the following chemical formula:

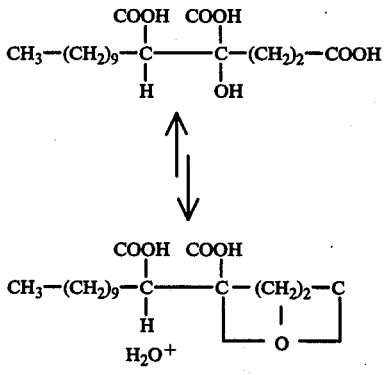

which is sometimes called spiculisporic acid.

It is desirable to control the pH value of the culture medium at a low value, say, lower than 3.5, preferably less than 3.0 as the following table representing the pH versus the produceable amount of the organic compound in the practice of the invention shows generally.

Table I

| Nitrogen source | pH | Produced organic compound (mg/ml) |
|---|---|---|
| $NH_4NO_3$ | 2.60 | 42 |
| " | 2.52 | 64 |
| " | 2.49 | 71 |
| " | 2.45 | 59 |
| " | 2.70 | 20 |
| $NaNO_3$ | 3.10 | 42 |
| " | 3.28 | 48 |
| " | 3.30 | 72 |
| " | 3.60 | 28 |
| urea | 2.63 | 40 |
| " | 2.52 | 57 |
| " | 2.45 | 45 |
| " | 2.70 | 20 |

In the course of the fermentation process, it is also desirable to replenish oxygen at a predetermined rate to the culture medium to maintain the same under a predertermined aerobic condition.

As noted hereinbefore, the machining fluid according to the present invention has the ability to inhibit corrosion and rust to metals which are corroded or become rusted immediately by the aqueous basic, conventional component of the fluid. It thus advantageously permits the use of a cast iron as the structural metal of the machine or machine parts which have been conventionally critical and makes accordingly the machines less costly. It also advantageously allows machines to be installed in a factory having other installations without rust preventing considerations even in the presence of exhaust fumes from the machines. Furthermore, the pump for the machining fluid is rendered free from cavitation and hence less expensive. Additionally, the clogging of the filter for the fluid is lessened, facilitating the removal of the trapped particles therefrom to make the machine here again less costly. It is also apparent that the anti-rusting characteristic of the machining fluid according to the invention makes the machine operation significantly easy and troublesome. It should further be noted that the machining fluid itself does not practically add to material cost and does not become harmful by incorporation of the additional component according to the invention.

The machining fluid according to the invention as used for electrochemical machining may advantageously include as the basic component an aqueous solution of at least one of a sulfate, e.g. sodium fulfate, chloride, e.g. sodium chloride, chlorate, e.g. potasium chlorate, phosphate, e.g. potassium phosphate, nitrate, e.g. sodium nitrate, nitrite, e.g. sodium nitrite and carbonate, e.g. sodium carbonate.

The machining fluid according to the invention as used for electrical discharge machining may advantageously include as the basic component water and may have a specific resistivity in the range between $10^3$ and $10^5$ ohm-cm.

According to a further feature of the present invention, the machining fluid may further contain micro-fine solid particles of a particle size in the range between 5 and 150 millimicrons and which may be composed of $SiO_2$, $Al_2O_3$, MgO, ZrO, $TiO_2$ or $Fe_2O_3$. By incorporating such micro-fine particles, it has been found that the machining fluid has the film rupture resistance at the interface between the tool and the workpiece increased significantly.

EXAMPLE I

One hundred milliliters aqueous culture medium containing 10% glucose, 0.05 to 0.5% each $MgSO_4$, $KH_2PO_4$ and $NH_4Cl$ and the balance civil water is used after sterilization to cultivate therein fungi belonging to Penicillium spiculisporum Lehman No. 10-1 added at a proportion of 0.01-to 0.05% to the medium. During the cultivation which is conducted at a temperature of 30° C. for 10 days, a rotary oscillation at 120 rpm is continuously imparted to the medium continuously to agitate it and replenish therein oxygen sufficiently and at a predetermined rate.

The fermented liquid is then subjected to a liquid-solid separation stage in which a liquid of about 90 liters is obtained by a centrifugal separator rotating at 3600 rpm and contains 0.7 to 1% of the organic compound belonging to an aliphatic acid. This liquid product has a pH value of 1.8 to 2.2.

The microbial liquid product is mixed at 2% by volume with an aqueous solution containing 1% by weight $NaNO_2$ and 1.2% by weight $Na_2CO_3$, the mixture having a pH value of 11. When this liquid is used for mechanical machining, no rust is formed on the workpiece surface. Next, a liquid obtained by mixing the microbial product at 2% by volume with an aqueous solution containing 3% by weight $NaNO_2$ and 1.2% by weight $Na_2CO_3$ and having a pH value 11 is used for electrochemical grinding and no rust is, in this case again, formed on the workpiece surface.

The solid product separated in the separation state from the liquid product just described may be dried and the organic compound belonging to an aliphatic acid is separated and recovered by removing therefrom mycelia in an alcoholic extraction method. Thus, from 0.9 kg of the separated solid, 3 kg of the organic acid is obtained by the alcoholic extraction and distillation.

The obtained organic acid is dissolved at 0.2% by weight into methanol and then mixed with an aqueous solution containing 3% by weight $NaNO_2$ and 0.25% $Na_2CO_3$. The resultant liquid which has a pH value of 10.2 is used for mechanical machining as well as for electrochemical grinding and in both cases no rust is formed. The use of the same organic acid incorporated into water for electrical discharge machining as well shows no rust formation.

EXAMPLE II

Workpieces composed of SKD 11 (alloy steel for cold working dies) are electrochemically machined with machining fluids containing 100 grams/liter of sodium nitrate and 40 grams/liter of Rochelle salts (potassium sodium tartrate) and varying proportions of the organic acid, viz. (A) 50 ppm, (B) 100 ppm, (C) 500 ppm, (D) 1000 ppm and (E) 0 ppm. The machining conditions are the following: machining mode: grinding, electrolyzing voltage: 12 volts, machining curren: 100 amperes/$cm^2$, used wheel: various sorts of electrically conductive wheel electrode, urging pressure: 5 to 10 kg/$cm^2$, cutting depth: 1 to 15 mm and feed rate: 5 to 80 mm/min. When machining fluids B, C and D are used, the grinding resistance is reduced by 5 to 20% to permit a smoothened progress of machining and machined surfaces of a roughness of 0.5 to 1 $\mu$max is obtained. Fluids B, C and D are superior in rust-inhibiting characteristic although even A has this ability and excellent compared with the conventional fluid E.

EXAMPLE III

Workpieces composed of SKD 61 are machined with fluids containing 60 grams/liter of sodium chloride and 35 grams/liter of sodium hydroxide and varying amounts of the organic acid, viz. (F) 50 ppm, (G) 100 ppm, (H) 500 ppm, (I) 1000 ppm and (J) 0 ppm under the machining conditions similar to those of the preceding example. The result shows the substantially identical rust-inhibiting abilities and forming characteristic to the preceding example. Further, with fluids, G, H and I, the grinding resistance is again significantly reduced and a smoothened machining operation is achieved compared with fluid (J).

EXAMPLE IV

A sodium salt of an aliphatic acid prepared according to the method as described in EXAMPLE I is mixed with civil water at a proportion of 150 ppm, the mixture having a specific resistivity of $2\times10^3$ ohm-cm. With this liquid, a workpiece composed of SKD-11 is machined by electrical discharge machining and no rust appears on the workpiece after lapse of 72 hours following the machining. Furthermore, the machining process of an increased stability and efficiency is observed. This appears to be due in part to the fact that the resistivity of the machining liquid is held adjustable in the range between $10^3$ and $10^5$ ohm-cm even with the additive according to the present invention.

EXAMPLE V

A machining fluid is prepared by mixing an organic acid prepared in the method as described in EXAMPLE I with 2% by volume sodium hydroxide, 5% by volume sodium nitrite and 0.5% by volume sesame oil, the mixed fluid having a pH value of 9. With this fluid, a workpiece composes of S55C (steel containing 0.55% by weight carbon) is ground by a tool comprised of a metal wire cladded with diamond particles. As a result, the amount of 0.018 gram is removed from the workpiece for 5 minutes with no rust formed thereon. Significantly, the addition of the vegetable oil (here sesame oil) is observed to act as a defoamer to the fluid so that the cooling efficiency in the machining region is sharply increased.

I claim:

1. A method of machining a metallic workpiece, comprising the steps of: cultivating a microorganism in an aqueous cultivation bath containing a saccharide, an inorganic salt and a nitrogen source to produce an organic compound of the spiculisporic acid structure, introducing 50 to 20,000 ppm of said organic compound into an aqueous machining liquid to form a corrosion resistant fluid, and displacing a tool and said workpiece relative to machine said workpiece in the presence of said fluid.

2. A machining fluid comprising an aqueous basic flushing component adapted to facilitate a workpiece-machining operation and an anti-rusting component including an organic compound which is produced by a fermentation process comprising cultivating a microorganism in a culture medium containing a saccharide, a nitrogen source and an inorganic salt and accumulated in a culture broth and separated and recovered from the culture broth and comprising an aliphatic acid or anhydrous derivative thereof having at least ten carbon atoms, three carboxy radicals and one hydroxyl radical.

3. The machining fluid according to claim 2 wherein said microorganism is selected from the group consisting of a bacterium of Arthrobacter genus, Penicillium speculisporum, Aspergillus spiculisporum and yeast fungi of Candida.

4. The machining fluid according to claim 2 wherein the saccharide is at least one compound selected from the group consisting of glucose, fructose, sucrose, molasses and starch.

5. The machining fluid according to claim 2 wherein the nitrogen source is at least one compound selected from the group consisting of ammonium chloride, ammonium sulfate, ammonium phosphate, ammonium liquid, ammonium tartrate, sodium nitrate, urea, corn steep liquor, peptone, yeast extract, meat extract and casein.

6. The machining fluid according to claim 2 wherein the inorganic salt is at least one compound selected from the group consisting of magnesium sulfate, sodium phosphate, acidic potassium phosphate, ferrous sulfate and zinc sulfate.

7. The machining fluid according to claim 2, further including 0.1 to 3% by volume of a vegetable oil.

8. The machining fluid according to claim 2 wherein oxygen is replenished at a predetermined rate to the culture medium during the fermentation process to maintain the medium under a predetermined aerobic condition.

9. The machining fluid according to claim 2 for use in electrochemical machining wherein the basic flushing component includes at least one salt selected from the group consisting of sulfate, nitrate, nitrite, chloride, chlorate, and phosphate and carbonate salts.

10. The machining fluid according to claim 2 for use in electrical discharge machining wherein the aqueous basic flushing component includes water, having a specific resistivity in the range between $10^3$ and $10^5$ ohm-cm.

11. The machining fluid according to claim 2 for use in contact or mechanical machining.

12. The machine fluid according to claim 2 wherein said organic compound has a spiculisporic acid or anydride structure.

* * * * *